US005842083A

United States Patent [19]

Miyamoto et al.

[11] Patent Number: 5,842,083

[45] Date of Patent: Nov. 24, 1998

[54] ELECTROSTATIC COPYING MACHINE

[75] Inventors: Kiyoaki Miyamoto; Kenichi Tanabe; Tadakazu Ogiri, all of Osaka, Japan

[73] Assignee: Mita Industrial Co., Ltd., Osaka, Japan

[21] Appl. No.: 856,084

[22] Filed: May 14, 1997

[30] Foreign Application Priority Data

May 15, 1996 [JP] Japan ..... 8-119937

[51] Int. Cl.[6] ..... G03G 15/00

[52] U.S. Cl. ..... 399/107; 399/124; 399/196; 399/202; 399/391

[58] Field of Search ..... 399/107, 202, 399/205, 211, 212, 392, 393, 108, 110, 124, 177, 196, 200, 206, 381, 388, 391

[56] References Cited

U.S. PATENT DOCUMENTS

| | | | |
|---|---|---|---|
| 4,947,206 | 8/1990 | Ito | 399/196 X |
| 5,038,170 | 8/1991 | Serita | 399/107 |
| 5,105,225 | 4/1992 | Honjo et al. | 399/206 X |
| 5,126,791 | 6/1992 | Kurihara | 399/196 X |
| 5,134,443 | 7/1992 | Sumi et al. | 399/121 |
| 5,214,473 | 5/1993 | Kusumoto | 399/177 X |
| 5,287,164 | 2/1994 | Watanabe | 399/391 |
| 5,398,101 | 3/1995 | Takada et al. | 399/196 X |

*Primary Examiner*—Arthur T. Grimley
*Assistant Examiner*—Hoan Tran
*Attorney, Agent, or Firm*—Antonelli, Terry, Stout & Kraus, LLP

[57] ABSTRACT

An electrostatic copying machine made up of an image-forming unit including a rotary drum having an exposure zone and a transfer zone, an optical system for projecting the image of the document to be copied onto the exposure zone, a copying paper-feeding system including a paper-feeding cassette that can be freely drawn to the front surface of the body of the copying machine, and a copying paper conveying passage for conveying a copying paper fed from the copying paper-feeding means through the transfer zone. A fixing device and a pair of paper-discharging rollers are disposed on the downstream side of the transfer zone. The paper-feeding cassette, image-forming unit, fixing device and the pair of paper-discharging rollers are successively arranged from one side toward the other side in the body of the copying machine within the maximum exposure scanning length of the optical system, and the copying paper conveying passage is arranged substantially linearly.

6 Claims, 2 Drawing Sheets

ELECTROSTATIC COPYING MACHINE

FIELD OF THE INVENTION

The present invention relates to an electrostatic copying machine. More specifically, invention relates to an electrostatic copying machine of the type equipped with an optical system including a moving unit which executes the scanning for exposure by moving relative to a transparent plate which is disposed on the upper surface of the body of the copying machine and on which will be placed a document that is to be copied, and equipped with a paper-feeding cassette mounted in the body of the copying machine so as to be freely drawn out of the front surface of the body of the copying machine.

DESCRIPTION OF THE PRIOR ART

A typical electrostatic copying machine of the above-mentioned conventional type comprises a machine body; copying machine; a transparent plate which is disposed on the upper surface of the body of the copying machine and on which will be placed a document that is to be copied; an image-forming means including a rotary drum having a photosensitive material on its surface, with an exposure zone and a transfer zone defined therealong an optical system for projecting the image of the document onto the exposure zone, the optical system including a moving unit which moves relative to the transparent plate to execute scanning for exposure; a copying paper-feeding means including a paper-feeding cassette mounted in the body of,-the copying machine so as to be freely drawn out of the front surface of the body of the copying machine; and a copying paper conveying passage for conveying a copying paper fed from the copying paper-feeding means through the transfer zone. A resist means is disposed at a position on the downstream side of the paper-feeding cassette but on the upstream side of the transfer zone and a fixing device and a pair of paper-discharging rollers are disposed in this order on the downstream side of the transfer zone in the copying paper conveying passage.

The electrostatic copying machine of the above-mentioned type has a paper-feeding cassette that is mounted within the body of the copying machine so as to be freely drawn out of the front surface thereof, and has an advantage from the standpoint of saving space in the side portions thereof compared with an electrostatic copying machine of the type in which the paper-feeding cassette is arranged such that it protrudes from the side of the body of the copying machine The electrostatic copying machine of the above-mentioned type, however, has the following problems that must be solved.

(1) In the lower part of the body of the copying machine is disposed the copying paper-feeding means including the paper-feeding cassette, and above the paper-feeding cassette in the body of the copying machine from one side toward the other side of the copying machine body are arranged a resist means, an image-forming means, a fixing device and a pair of paper-discharging rollers. Due to this layout, the copying paper conveying passage is inverted between the copying paper-feeding means and the resist means. As a result, the copying paper is sharply curved while it is conveyed through the copying paper conveying passage, making it difficult to smoothly and reliably convey (pass) so-called thick papers which have a larger thickness than the ordinary copying papers. Moreover, the copying papers that are conveyed in an inverted manner are a large factor giving rise to a frequent occurrence of jamming.

(2) Since the copying paper conveying passage is curved, furthermore, the distance increases from the paper-feeding cassette to the resist means. Therefore, an increased time is required for copying a first document, i.e., an increased time is required for a first copying operation. In particular, in the copying machine of the type in which a plurality of documents are copied while being placed sheet by sheet on the transparent plate, the time required for the copying operation is lengthened conspicuously with an increase in the number of documents to be copied, and the total time of copying is lengthened.

SUMMARY OF THE INVENTION

A principal object of the present invention is to provide a novel electrostatic copying machine which enables even thick papers to be easily conveyed, so as to decrease the probability of jamming while saving space, and which makes it possible to shorten the time for performing a first copying operation.

In order to accomplish the above-mentioned principal object according to the present invention, there is provided an electrostatic copying machine comprising a copying machine body, a transparent plate which is disposed on the upper surface of the body of the copying machine and on which will be placed a document that is to be copied, an imageforming means including a rotary drum having a photosensitive material on its surface, with an exposure zone and a transfer zone defined therealong, an optical system for projecting the image of a document onto the exposure zone, the optical system including a moving unit which moves relative to the transparent plate to execute scanning for exposure, a copying paper-feeding means including a paper-feeding cassette mounted within the body of the copying machine so as to be freely drawn out of the front surface of the body of the copying machine, and a copying paper conveying passage for conveying a copying paper fed from the copying paper-feeding means through the transfer zone, a resist means being disposed at a position on the downstream side of the paper-feeding cassette but on the upstream side of the transfer zone, and a fixing device and a pair of paper-discharging rollers being disposed on the downstream side of the transfer zone in the copying paper conveying passage, wherein said paper-feeding cassette, said resist means, said image-forming means, said fixing device and said pair of paper-discharging rollers are successively arranged from one side toward the other side in the body of said copying machine within a range of a maximum exposure scanning length of said optical system, and said copying paper conveying passage is arranged substantially linearly.

Accordingly, the copying paper is curved to an extremely lesser extent as it is conveyed. Therefore, even a thick paper is smoothly and reliably conveyed and, further jamming occurs less frequently compared to the prior art. Moreover, with the copying paper conveying passage being arranged substantially linearly, the distance from the paper-feeding cassette to the resist means is shortened compared with that of the prior art, and so the time for performing a first copying operation is shortened compared with that of the prior art. In particular, in the case where a plurality of documents are copied while being placed sheet by sheet on the transparent plate, therefore, the total time for all the copying operations is greatly shortened. This electrostatic copying machine has a paper-feeding cassette that is mounted in the body of the copying machine so as to be freely drawn out of the front surface of the body of the copying machine. Hence, the above-mentioned principle object is achieved, while saving space of the side portions thereof.

According to the present invention, there is further provided, in addition to the above-mentioned constitution, an electrostatic copying machine wherein a by-passing copying paper-feeding means, including a copying paper-placing means, is disposed above said paper-feeding cassette, and a copying paper of a maximum permissible size is fed into said copying paper conveying passage by said by-passing copying paper-feeding means.

In the electrostatic copying machine constituted according to the present invention, the paper-feeding cassette mounted in the body of the copying machine may be of a relatively small size for setting copying papers which are smaller than the copying papers of the maximum permissible size. In consequence, even copying papers of the maximum permissible size that cannot be set to the paper-feeding cassette can be used, while the whole electrostatic copying machine is able to be constructed in a compact size (particularly, in a reduced size in the right-and-left direction as viewed from the front) and hence, with accomplishment of saving in space.

According to the present invention, there is further provided, in addition to the above-mentioned second constitution, an electrostatic copying machine wherein said copying paper-placing means includes a main copying paper-placing plate and an auxiliary copying paper-placing plate, said main copying paper-placing plate is disposed above said paper-feeding cassette, and said auxiliary copying paper-placing plate protrudes sidewardly as of an extension of said main copying paper-placing plate beyond said side portion of said body of said copying machine so as to be selectively positioned in a use position, where the copying paper-placing area is expanded in cooperation with said main copying paper-placing plate, or in a non-use position, where the auxiliary copying paper-placing plate is substantially held within the body of said copying machine through the side portion thereof.

In the present invention, the copying paper can be set very easily when the by-passing copying paper-feeding means is utilized, and the copying paper is reliably fed. When the by-passing copying paper-feeding means is not utilized, no member (auxiliary copying paper-placing plate) protrudes beyond the side of the body of the copying machine, making it possible to decrease the required space and to greatly decrease the possibility of breakage of the auxiliary copying paper-placing plate. Therefore, the copying machine can be easily moved or transported.

According to the present invention, there is further provided, in addition to the above-mentioned third constitution, an electrostatic copying machine wherein the body of said copying machine includes one side portion and another side portion that are so disposed as to extend substantially in the vertical direction, said maximum exposure scanning length of said optical system is defined by an exposure scanning space arranged to extend in the horizontal direction between said one side portion and said other side portion of the upper part in the body of said copying machine, and a recessed space is formed which is continuously open from a portion of the front surface of the body of the copying machine to a portion of one side thereof between part of said exposure scanning space and said copying paper-placing means.

In the present invention, even copying papers of sizes different from the size of the copying papers set to the paper-feeding cassette can be directly set onto the copying paper-placing means of the by-passing copying paper-feeding means from the front surface side of the machine, not through the side portion of the body of the copying machine. Therefore, the copying papers can be set very easily onto the copying paper-placing means of the by-passing copying paper-feeding means. Therefore, the by-passing copying paper-feeding means makes it possible to greatly reduce space for setting the copying papers which, otherwise, is required on the outer side portion of the body of the copying machine and hence, makes it possible to further decrease the required space. Besides, since space in the body of the copying machine is effectively utilized, the electrostatic copying machine offers a multiplicity of functions despite of its compact size.

According to the present invention, there is further provided, in addition to the above-mentioned first constitution, an electrostatic copying machine wherein a by-passing copying paper-feeding means, including a copying paper-placing means, is disposed above said paper-feeding cassette, a ceiling housing is disposed in the body of said copying machine to cover the upper side of at least part of said paper-feeding cassette, and the upper surface of said ceiling housing also serves as said copying paper-placing means.

In the present invention, the copying paper-placing means of the by-passing copying paper-feeding means is not separately provided, but is formed by the upper surface of the ceiling housing, contributing to utilizing the member for multiple purposes and to decreasing the cost.

According to the present invention, there is further provided, in addition to the above-mentioned first constitution, an electrostatic copying machine wherein;

said moving unit of said optical system includes a first moving frame which reciprocatingly moves along said transparent plate and includes a source of light for exposure, and a second moving frame which reciprocatingly moves in synchronism with the reciprocating motion of said first moving frame in the direction in which said first moving frame reciprocatingly moves at a speed one-half the moving speed of said first moving frame;

a position at which said first moving frame starts scanning for exposure is defined to be the position closest to the other side of the body of said copying machine on the most downstream side of said copying paper conveying passage, and a position at which said second moving frame starts scanning for exposure is defined to be an intermediate portion between said first moving frame and said side portion of the body of said copying machine on the most upstream side of said copying paper conveying passage;

the scanning for exposure is executed as said first moving frame is moved from said other side portion to said one side portion and as said second moving frame is moved from said intermediate portion to said one side portion; and a maximum exposure scanning position of said second moving frame is defined to be a position closest to said one side portion of the body of said copying machine, and a maximum exposure scanning position of said first moving frame is defined to be a position closest to said second moving frame.

In the present invention, the position where the first moving frame of the optical system starts scanning for exposure relative to the rotary drum, is kept from greatly protruding toward the other side of the electrostatic copying machine, as will be easily comprehended from the comparison with the case where the conventional optical system of this type (see, for example, Japanese Laid-Open Patent Publication No. 105270/1989) is applied to an electrostatic copying machine having the above-mentioned first constitution. Therefore, the length between one side portion and the other side portion of the electrostatic copying machine can be minimized, and the electrostatic copying machine can be constructed in a compact size as a whole, whereby saving in space is achieved.

DETAILED DESCRIPTION OF THE PREFERRED EMBODIMENTS

Figure 1:
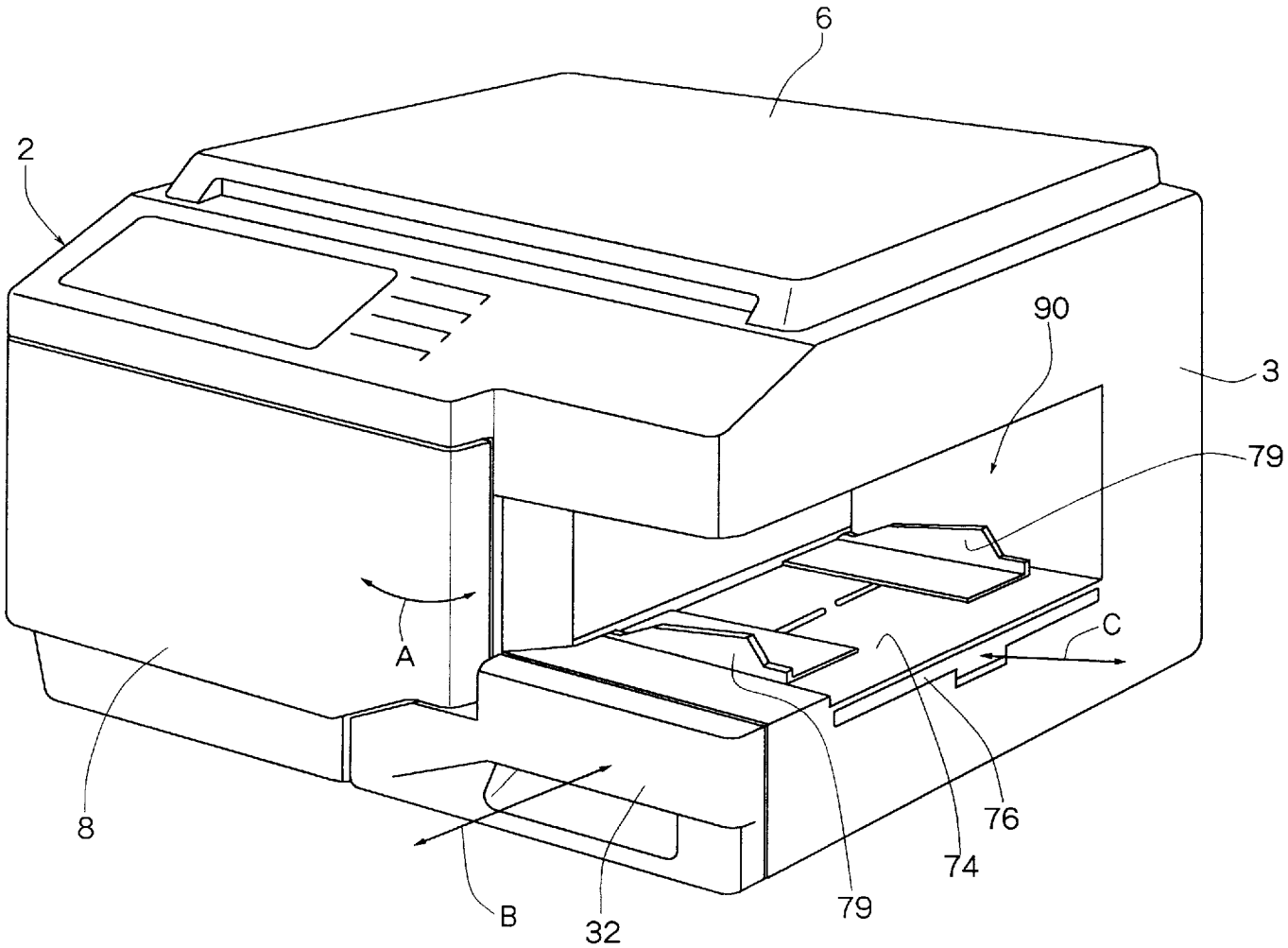
FIG. 1 is a perspective view of an electrostatic copying machine constituted according to an embodiment of the present invention.

The electrostatic copying machine constituted according to an embodiment of the present invention will now be described with reference to FIGS. 1 and 2. The illustrated electrostatic copying machine is provided with a copying machine body (housing) generally designated at 2. The body 2 of the copying machine has a right side portion (one side portion) 3 and a left side portion (other side portion) 4 which extend nearly in the vertical direction, and has a nearly rectangular parallelopiped shape as a whole. Onto the upper surface of the body 2 of the copying machine is secured a transparent plate 5 on which will be placed a document that is to be copied. On the upper surface of the transparent plate 5 is provided a document holder 6 which can be opened and closed to hold a document that is placed on the transparent plate 5 and to cover the whole transparent plate 5. A front cover 8 is fitted to the front surface (the surface of the front side in FIG. 2) of the body 2 of the copying machine. The front cover 8 can be opened and closed in the direction of arrow A in FIG. 1 about a hinge that is not shown but that is provided near the left side portion 4 of the body 2 of the copying machine. In its closed state, the front cover 8 constitutes part of the front surface of the body 2 of the copying machine.

A partitioning plate 10 is arranged to extend substantially horizontally in the body 2 of the copying machine. The partitioning plate 10 divides the interior of the body 2 of the copying machine into an upper space and a lower space. In the upper space is arranged an optical system 12 that will be described later in detail. In the lower space, a rotary drum 14 having a photosensitive material disposed on the surface thereof is rotatably provided at a position on the left side of the center in the right-and-left direction. The rotary drum 14 can rotated in the clockwise direction in FIG. 2 and is surrounded by a corona discharger 16 for electric charging, a developing device 18, a corona discharger 20 for transfer, a corona discharger 22 for separation, a cleaning device 24 and a lamp 26 for removing electric charge, all positioned in the order mentioned in the direction of rotation. An exposure zone 25 is defined on the surface of the photosensitive material of the rotary drum 14 between the corona discharger 16 for electric charging and the developing device 18. And, a transfer zone 27 is defined at a portion facing to the corona discharger 20 for transfer. The rotary drum 14 and the surrounding devices constitute an image-forming means 28.

A copying paper-feeding means 30 is disposed at a lower portion foward the right side 3 in the body 2 of the copying machine. The copying paper-feeding means 30 includes a paper-feeding cassette 32 and a paper-feeding roller 34. The paper-feeding cassette 32 is mounted in the body 2 of the copying machine so as to be allowed to be drawn to the front surface of the body 2 of the copying machine. An arrow B in FIG. 1 indicates the direction in which the paper-feeding cassette 32 is drawn and accommodated. In the paper-feeding cassette 32 is disposed a placing plate 33. The placing plate 33 pivots about on the right end thereof and its left end is upwardly urged at all times by a spring that is not shown. The copying papers are placed on the placing plate 33 in a stacked manner, and are set (accommodated) in the paper-feeding cassette 32. In a state in which the paper-feeding cassette 32 is mounted in the body 2 of the copying machine, the front surface of the paper-feeding cassette 32 constitutes part of the front surface of the body 2 of the copying machine. The paper-feeding roller 34 is mounted to rotate in the body 2 of the copying machine and extends in a back-and-forth direction (front-and-back direction in FIG. 2) at an upper portion on the left end of the paper-feeding cassette 32. The paper-feeding roller 34 is constituted by a so-called half moon-shaped roller of which the peripheral surface is partly cut away.

In the body 2 of the copying machine is further arranged a copying paper conveying passage 40 which conveys a copying paper fed by the copying paper-feeding means 30 past the transfer zone 27 of the rotary drum 14. A pair of conveyer rollers 42 and a resist shutter 44 constituting a resist means are arranged in the copying paper conveying passage 40 between the paper-feeding cassette 32 and the rotary drum 14, positioned from the upstream side toward the downstream side in the order mentioned. Furthermore, a fixing device 46 and a pair of paper-discharging rollers 48 are arranged in the copying paper conveying passage 40 on the downstream side of the rotary drum 14, positioned from the upstream side toward the downstream side in the order mentioned. On the left side portion 4 of the body 2 of the copying machine is mounted a paper-discharging tray 49 for receiving the copying papers discharged from the pair of paper-discharging rollers 48. The copying paper conveying passage 40, further, has a guide means constituted by several guide plates for guiding the conveyance of the copying paper as shown in FIG. 2.

In the upper space in the body 2 of the copying machine is disposed an optical system 12 for projecting the image of a document placed on the transparent plate 5 onto the exposure zone 25 of the rotary drum 14. The optical system 12 comprises a first moving frame 54 having an exposure lamp 50, which is a source of light for exposure, and a reflector 52, a second moving frame 60 having reflectors 56 and 58, a lens frame 62 having at least a piece of lens, a stationary frame 68 having reflectors 64 and 66, and a stationary reflector 69.

The position (home position) at which the first moving frame 54 starts scanning for exposure is defined to be a position close to the left side portion 4 of the body 2 of the copying machine at the most downstream end of the copying paper conveying passage 40 (in other words, positioned adjacent the copying paper-discharging side in the body 2 of the copying machine). Further, it is important that the position at which the second moving frame 60 starts scanning for exposure is defined to be an intermediate position between the first moving frame 54 and the right side portion 3 of the body 2 of the copying machine at the most upstream end of the copying paper conveying passage 40 (i.e., nearly a middle portion between the right side portion 3 and the left side portion 4). FIG. 2 illustrates a state where the first moving frame 54 and the second moving frame 60 are, respectively, located at the positions for starting the scanning for exposure.

The stationary frame 68 is disposed under the first moving frame 54 when frame 54 is at the position for starting the scanning for exposure, and the lens frame 62 is disposed between the stationary frame 68 and the second moving frame 60 when frame 60 is at the position for starting the scanning for exposure (or, more specifically, between the reflector 64 of the stationary frame 68 and the reflector 58 of the second moving frame 60). A stationary reflector 69 is disposed at a distance toward the right side portion 3 in the body 2 of the copying machine with respect to the stationary frame 68.

The first moving frame 54 reciprocatingly moves in the horizontal direction along the transparent plate 5, and the second moving frame 60 reciprocatingly moves in synchronism with the reciprocating motion of the first moving frame 54 in the direction of reciprocating motion of the first moving frame 54, but at a speed one-half the moving speed of the first moving frame 54. The first moving frame 54 and the second moving frame 60 constitute a moving unit of the optical system 12. The scanning for exposure by these moving units is executed as the first moving frame 54 moves from the adjacent left side portion 4 toward the right side portion 3, and as the second moving frame 60 moves from the intermediate position toward the right side portion 3.

The position at which the second moving frame 60 ends the scanning for exposure is defined to be a position close to the right side portion 3 of the body 2 of the copying machine, and the position at which the first moving frame 54 ends the scanning for exposure is defined to be a position close to the second moving frame 60 when frame 60 is at the position where the scanning for exposure is finished. These positions are shown by the two-dot chain line FIG. 2. By the above-mentioned scanning for exposure, the image of the document placed on the transparent plate 5 is projected onto the exposure zone 25 of the rotary drum 14 via reflector 52, reflector 56, reflector 58, lens frame 62, reflector 64, reflector 66 and stationary reflector 69. When the copying magnification is to be changed, the lens frame 62 and the reflectors 64 and 66 of the stationary frame 68 are moved in the horizontal direction according to the magnification.

Therefore, the upper space in the body 2 of the copying machine defines a scanning space that extends in the horizontal direction, and the maximum exposure scanning length of the optical system 12 is defined by the position at which the first moving frame 54 starts scanning for exposure and the position at which the second moving frame 60 ends the scanning for exposure. The distance between the right side portion 3 and the left side portion 4 of the body 2 of the copying machine is defined to be slightly greater than the maximum exposure scanning length.

In the present invention, it is important that the paper-feeding cassette 32, conveyer rollers 42, resist shutter 44, image-forming means 28, fixing device 46 and the pair of paper-discharging rollers 48 are successively arranged from the right side portion 3 toward the left side portion 4 in the body 2 of the copying machine within the maximum exposure scanning length of the optical system 12, and that the copying paper conveying passage 40 is arranged substantially linearly. Though there is no particular limitation, the copying paper conveying passage 40 is arranged to extend nearly in the horizontal direction.

Above the paper-feeding cassette 32 is disposed a by-passing copying paper-feeding means 72 that includes a copying paper-placing means 70. The copying paper-placing means 70 includes a main copying paper-placing plate 74 and an auxiliary copying paper-placing plate 76. The main copying paper-placing plate 74 is disposed above the paper-feeding cassette 32. The auxiliary copying paper-placing plate 76 protudes sidewardly in the direction of an extension of the main copying paper-placing plate 74, beyond the right side portion 3 of the body 2 of the copying machine so as to be selectively positioned to a use position (indicated by a solid line in FIG. 2), where the copying paper-placing area is expanded in cooperation with the main copying paper-placing plate 74, or to a non-use position (indicated by a solid line in FIG. 1 and indicated by a two-dot chain line in FIG. 2), where it is substantially held within the body 2 of the copying machine through the right side portion 3 thereof. Therefore, the auxiliary copying paper-placing plate 76 freely moves in the direction of arrow C in FIG. 1 with respect to the body 2 of the copying machine.

In the body 2 of the copying machine is disposed a ceiling housing 78 which covers the upper portion of at least part of the paper-feeding cassette 32. The upper surface of the ceiling housing 78 is so constituted as to serve also as the main copying paper-placing plate 74. On the main copying paper-placing plate 74 are disposed a pair of width-limiting members 79 which are so constituted as can be brought close to each other or separated away from each other. In the ceiling housing 78 is provided space for slidably accepting the auxiliary copying paper-placing plate 76. The auxiliary copying paper-placing plate 76 may be mounted on the right side portion 3 of the body 2 of the copying machine by a hinge mechanism, so as to be selectively brought to the use position and to the non-use position where it does not protrude beyond the right side portion 3 as described above.

The by-passing copying paper-feeding means 72 further has paper-feeding rollers 80 and 82, a placing plate 84 and a restriction plate 86. The paper-feeding roller 80 is constituted by a half moon-shaped roller like the above-mentioned paper-feeding roller 34 and works to feed the copying paper placed on the copying paper-placing means 70 toward the copying paper conveying passage 40 in cooperation with the paper-feeding roller 82. The placing plate 84 is mounted pivotably at its right end on the ceiling housing 78 and is selectively brought to a descended position indicated by a solid line in FIG. 2 and to an ascended position indicated by a two-dot chain line in FIG. 2. When the copying papers are set to the copying paper-placing means 70, the placing plate 84 has been brought to the descended position, and the front ends of the copying papers are restricted by the restriction plate 86. When the copying paper set to the copying paper-placing means 70 is to be fed by the copying paper-feeding means 72, the placing plate 84 is brought to the ascended position.

A copying paper of a maximum permissible size set to the document placing plate means 70 or a copying paper of a size smaller than the copying paper set to the paper-feeding cassette 32, is fed to the copying paper conveying passage 40 by the by-passing copying paper-feeding means 72. Therefore, on the downstream side of the paper-feeding rollers 80 and 82 is disposed a by-passing copying paper conveying passage 88 for conveying the copying paper toward the pair of the conveyer rollers 42. According to this embodiment, the paper-feeding cassette 32 is used for holding copying papers of a size JIS-A4, and the copying paper-placing means 70 is used for holding copying papers of a size JIS-A3 which is the maximum permissible size. On the main copying paper-placing plate 74 are arranged the pair of width-limiting members 79 which enable copying papers of sizes smaller than size A4 to be easily set on the main copying paper-placing plate 74.

A nearly rectangular parallelopiped recessed space, 90 is formed between the main copying paper-placing plate 74 and part of the scanning space which is the upper space formed in the body 2 of the copying machine, by being partitioned by the partitioning plate 10. The recessed space 90 is continuously open from a position near the right side portion 3 of the front surface of the body 2 of the copying machine to the right side portion 3.

As will be obvious from the foregoing description, important features of the present invention resides in the constitution (layout) of the optical system 12 and in the layout of the whole of the above-mentioned constituent elements. The constituent elements such as image-forming means 28, copying paper-feeding means 30, by-passing copying paper-feeding means 72, conveyer rollers 42 disposed in the copying paper conveying passage 40, resist shutter 44, fixing device 46 and the pair of paper-discharging rollers 48, may be constituted in a manner known among people skilled in the art, and their constitutions are not described here in further detail.

Briefly described below is the copying operation of the above-mentioned electrostatic copying machine. A document to be copied is placed on the transparent plate 5 with its left end as a reference point. The document that is placed is covered by the document holder 6. The first moving frame 50 and the second moving frame 60 are reciprocatingly moved between the positions at which the scanning for exposure starts and the positions at which the scanning for exposure ends. The exposure lamp 50 illuminates the whole surface of the document, and light reflected by the document falls via the above-mentioned constituent elements of the optical system 12 on the exposure zone 25 onto the photosensitive material on the surface of the rotary drum 14 while the drum is rotating in the clockwise direction, and an electrostatic latent image corresponding to the document is formed. An electric charge of a predetermined polarity has been uniformly imparted, by the corona discharger 16 for electric charging, to the surface of the photosensitive material in a charging zone that is not shown but is defined on the upstream side of the exposure zone 25. With the rotation of the rotary drum 14, the developing device 18 applies toner particles onto the surface of the photosensitive material so that the electrostatic latent image is developed into a toner image.

When a copying paper of the size A4 is used, the toner image is transferred, in the transfer zone 27, onto the copying paper conveyed by the copying paper-feeding means 30 from the paper-feeding cassette 32 along the copying paper conveying passage 40, by the action of the corona discharger 20 for transfer. When a copying paper of the size A3 or a size smaller than the size A4 is used, the toner image is similarly transferred, in the transfer zone 27, onto the copying paper conveyed by the by-passing copying paper-feeding means 72 from the copying paper-placing means 70 along the copying paper conveying passage 40. The copying paper onto which the toner image has been transferred is peeled off the rotary drum 14 by the action of the corona discharger 22 for separation and is further conveyed along the copying paper conveying passage 40. The toner image is fixed on the copying paper through the fixing device 46, and the copying paper is discharged by the pair of paper-discharging rollers 48 onto the paper-discharging tray 49. With the rotation of the rotary drum 14, furthermore, the residual toner on the surface of the photosensitive material is removed by the cleaning device 24, and the residual electric charge is removed by the lamp 26 for removing electric charge.

Figure 2:
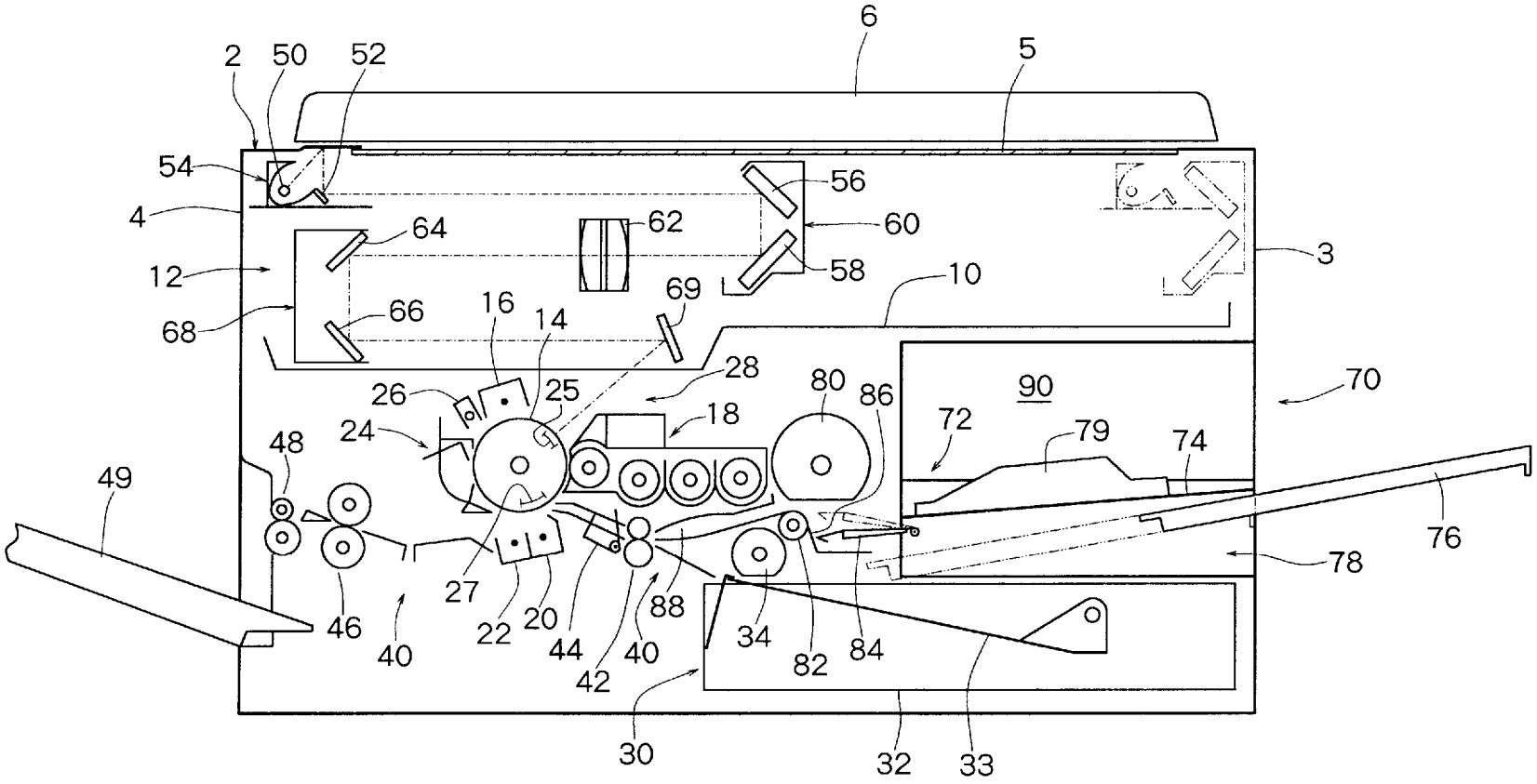
FIG. 2 is a schematic sectional view of the electrostatic copying machine shown in FIG. 1.

As shown in FIG. 2, the copying paper conveying passage 40 is formed substantially linearly. Therefore, the copying paper is curved very little while it is being conveyed. Moreover, since the copying paper conveying passage 40 is formed substantially linearly, the distance from the copying paper-feeding means 30 and from the by-passing copying paper-feeding means 72 to the resist shutter 44 which is the resist means can be shortened compared with that of the conventional copying paper conveying passage which is curved relatively sharply.

As will be easily understood from the above description and drawings, the rotary drum 14 onto which the image of the document is projected by the optical system 12 is positioned to the left side of the center of the body 2 of the copying machine in the right-and-left direction. When the optical system of a conventional type (see, for example, Japanese Laid-Open Patent Publication No. 105270/1989) is adapted to the above electrostatic copying machine, therefore, the position, at which the moving unit of the optical system starts scanning for exposure, with respect to the rotary drum 14, greatly protrudes toward the left side of the electrostatic copying machine. Therefore, the space in the right-and-left direction in the body 2 of the copying machine greatly increases, and the electrostatic copying machine as a whole becomes bulky, resulting in a wasteful increase in space. According to the layout of the optical system 12 of the present invention, on the other hand, the above-mentioned problem is solved, the length between the right side portion 3 and the left side portion 4 of the body 2 of the copying machine is minimized irrespective of the position of the rotary drum 14, and the electrostatic copying machine as a whole is constructed in a compact size, whereby saving in space can be achieved.

In the foregoing was described an electrostatic copying machine constituted according to an embodiment of the present invention. The invention, however, is in no way limited to the above-mentioned embodiment only, but can be changed or modified in a variety of ways without departing from the scope of the invention.

According to the electrostatic copying machine of the present invention, the distance between one side portion and the other side portion (distance in the right-and-left direction as viewed from the front) is minimized and, hence, the whole apparatus is constructed in a compact size, and saving in space can be surely achieved. Moreover, even thick papers are easily conveyed, the probability of jamming is decreased, and the time for taking a first copy is shortened, resulting in contributing to obtaining copies more quickly.

What we claim is:

1. An electrostatic copying machine comprising:

a copying machine body;

a transparent plate disposed on an upper surface of said copying machine body for placement thereon of a document to be copied;

image-forming means, including a rotary drum having a photosensitive surface with an exposure zone and a transfer zone defined therealong;

an optical system for projecting an image of the document onto the exposure zone, said optical system including a moving unit which moves relative to said transparent plate to execute scanning for exposure over a maximum scanning length;

copying paper-feeding means, including a paper-feeding cassette mounted in said copying machine body so as to be freely drawn out of the front surface of said copying machine body;

means defining a copying paper conveying passage for conveying a copying paper fed from said copying paper-feeding means past said transfer zone;

resist means disposed in said copying paper conveying passage at a position on the downstream side of said paper-feeding cassette, but on the upstream side of said transfer zone; and a fixing device and a pair of paper-discharging rollers disposed in said copying paper conveying passage at a position on the downstream side of said transfer zone, wherein said paper-feeding cassette, said resist means, said image-forming means, said fixing device, and said pair of paper-discharging rollers are successively arranged from a first side toward a second side of said copying machine body within a distance not greater than the maximum scanning length of said optical system, and said copying paper conveying passage is arranged substantially linearly.

2. An electrostatic copying machine according to claim 1, further comprising by-passing copying paper-feeding means, including copying paper-placing means disposed above said paper-feeding cassette to permit feeding therefrom of copying paper into said copying paper conveying passage.

3. An electrostatic copying machine according to claim 2, wherein said copying paper-placing means includes a main copying paper-placing plate and an auxiliary copying paper-placing plate, said main copying paper-placing plate being disposed above said paper-feeding cassette, and said auxiliary copying paper-placing plate being selectively positionable to a use position in which said auxiliary copying paper-placing plate protrudes sidewardly beyond said first side of said copying machine body to provide an extension of said main copying paper-placing plate so as to expand the copying paper-placing area in cooperation with said main copying paper-placing plate, or to a non-use position in which said auxiliary copying paper-placing plate is held substantially within said copying machine body.

4. An electrostatic copying machine according to claim 2, wherein:

said copying machine body has a first vertically extending side portion on said first side of said copying machine body and a second vertically extending side portion on said second side of said copying machine body;

the maximum exposure scanning length of said optical system is defined within an exposure scanning space arranged to extend in the horizontal direction between said first side portion and said second side portion in the upper part of said copying machine body; and said copying machine body has a continuously open recess, including a portion of the front surface of said copying machine body and a portion of said first side portion of said copying machine body and between said exposure scanning space and said copying paper-placing means.

5. An electrostatic copying machine according to claim 1, further comprising a ceiling housing disposed in said copying machine body to cover the upper side of at least part of said paper-feeding cassette and having an upper surface serving as copying paper-placing means of a by-passing copying paper-feeding means.

6. An electrostatic copying machine according to claim 1, wherein:

said moving unit of said optical system comprises a first moving frame adapted to reciprocatingly move along said transparent plate between a first moving frame scanning start position and a first moving frame scanning end position and including a source of light for exposure; and a second moving frame adapted to reciprocatingly move along said transparent plate between a second moving frame scanning start position and a second moving frame scanning end position in synchronism with the reciprocating movement of said first moving frame and in the direction of movement of said first moving frame, and at a speed one-half the movement speed of said first moving frame;

said first moving frame scanning start position is defined to be a position close to said second side portion of said copying machine body; and said second moving frame scanning start position is defined to be an intermediate position between said first moving frame scanning start position and said first side portion of said copying machine body;

the scanning for exposure is executed as said first moving frame is moved from said second side portion toward said first side portion and as said second moving frame is moved from said intermediate position toward said first side portion; and said second moving frame scanning end position is defined to be a position close to said first side portion of said copying machine body, and said first moving frame scanning end position is defined to be a position close to said second moving frame scanning end position.

* * * * *